United States Patent [19]

Ikegaya

[11] 3,988,217

[45] Oct. 26, 1976

[54] PROCESS FOR PRODUCING A PROTECTIVE FILM ON AN ALUMINUM SURFACE

[75] Inventor: Masashi Ikegaya, Shizuoka, Japan

[73] Assignee: Riken Lightmetal Industry Co., Ltd., Japan

[22] Filed: Mar. 10, 1975

[21] Appl. No.: 556,975

Related U.S. Application Data

[62] Division of Ser. No. 300,159, Oct. 24, 1972, Pat. No. 3,909,371.

[30] Foreign Application Priority Data

Oct. 22, 1971 Japan ..... 46-83339

[52] U.S. Cl. ..... 204/33; 204/181

[51] Int. Cl.[2] ..... C25D 5/44; C25D 13/06

[58] Field of Search ..... 204/33, 181, 38 E

[56] References Cited

UNITED STATES PATENTS

| | | | |
|---|---|---|---|
| 3,775,266 | 11/1973 | Ikeda et al. | 204/38 E |
| 3,799,848 | 3/1974 | Kolic et al. | 204/38 E |
| 3,930,964 | 1/1976 | Takahashi et al. | 204/38 E |

*Primary Examiner*—R. L. Andrews

*Attorney, Agent, or Firm*—Bucknam and Archer

[57] ABSTRACT

A process is disclosed for producing a firmly adhered, corrosion resistant film on an aluminum or aluminum alloy surface by means of anodization using an electrolyte containing at least one of the compounds selected from the group consisting of quaternary ammonium salts, aliphatic primary amines and aliphatic secondary amines which compounds act upon a coating to cause the same to adhere intimately to the aluminum surface on one hand and impart corrosion resistance to the latter on the other.

7 Claims, No Drawings

PROCESS FOR PRODUCING A PROTECTIVE FILM ON AN ALUMINUM SURFACE

This application is a division of Ser. No. 300,159, Oct. 24, 1972, U.S. Pat. No. 3,909,371.

This invention relates to a process of producing on an aluminum or aluminum alloy surface a protective, ornamental and corrosive resistant film. More specifically, the present invention is concerned with the process in which an aluminum substrate is coated by immersion deposit with a continuous, smooth and firmly adhered resinous film. Yet more specifically, the invention is further concerned with the aluminum surface treatment in which an aluminum surface is provided with an anodized under-coat and a resinous over-coat simultaneously.

A number of processes have been hitherto been proposed for treating and finishing aluminum-bearing substrates so that product aluminum articles are resistant to environmental attack, i.e. corrosion by acidic or alkaline atmosphere and will present a continuous, smooth, level surface appearance. Prior to the application of a protective coating and/or an ornamental dye, the aluminum surface is subjected to an undercoat treatment such as by anodization and chemical conversion which has important bearing upon the properties of a protective film formed over the under-coat. Therefore, a variety of processes have also been proposed for forming an under-coat on an aluminum substrate. For example, there is known a process wherein a film is formed by chemical conversion on an aluminum surface, followed by application of a protective outer coating. According to this process, the protective resinous film is securely adhered to the under-coated film but the coated aluminum surface is not satisfactorily corrosion-resistant. There is also known a process wherein the aluminum surface is anodized prior to the application of a protective coating. The anodized surface available by this process is well resistant to corrosion and superior in many respects chemically converted aluminum surface. But, the anodization employed therefor is extremely costly. In order to overcome the above drawbacks, there has been proposed an advanced process in which anodization is combined with chemical conversion, but such combined process is rather complicated and economically feasible.

Whereas, it is an object of the present invention to provide an novel process for producing a protective, corrosion-resistant film on an aluminum surface, which process will eliminate the foregoing difficulties of the various prior art processes.

It is a more specific object of the invention to provide a novel process which is capable of producing on an aluminum substrate an anodized under-coat and a resinous over-coat simultaneously in a single bath operation.

We have discovered that a desired corrosion-resistant oxide film can be produced on an aluminum or aluminum alloy surface by means of anodization employing an electrolyte which contains at least one of the compounds selected from the group consisting of quaternary ammonium salts, aliphatic primary amines and aliphatic secondary amines. We have also ascertained that the oxide film greatly enhances adhesion of the coating composition to the aluminum surface. The oxide film according to the invention is substantially transparent, hence a variety of colors may be chosen for an over-coat to be applied to the aluminum product.

In accordance with one aspect of the invention, there is provided a process which essentially comprises: degreasing, cleaning and water-rinsing the surface; etching the water-washed surface with an alkaline solution; neutralizing and water-washing the etched surface; and anodizing the surface in an electrolyte containing 1.0–15.0 weight percent of at least one member selected from the group consisting of quaternary ammonium salts, aliphatic primary amines and aliphatic secondary amines. Another aspect of the invention resides in the provision of a process which comprises: degreasing, cleaning and water-rinsing the surface; etching the water-rinsed surface with an alkaline solution; neutralizing and water-washing the etched surface; and anodizing the surface in an electrolyte containing 1.0–15.0 weight percent of at least one member selected from the group consisting of quaternary ammonium salts, aliphatic primary amines and aliphatic secondary amines and 20.0–50.0 weight percent of a water-soluble thermosetting resin; allowing the thus anodized surface to set; and drying and hardening the surface at a temperature of 150°–200° C over a period of 15 – 30 minutes.

The term quaternary ammonium salts as used herein includes for example ETHODUOMEEN (trade name for ethylene oxide adduct of fatty acid diamine). The term aliphatic primary amines includes ethylene diamine and the like. The term aliphatic secondaty amines includes dimethyl amine, N-methyl ethanol amine and the like. These compounds named as above have now been found capable of forming an oxide film on an aluminum surface when used in determined amounts. Amounts of less than 1.0% will result in poor oxide film and fail to enhance adhesion of the coating compositin to the aluminum surface. Amounts in excess of 15.0% are too great to become soluble.

The term water-soluble thermosetting resins as used herein includes acrylic resins, alkyd resins, acrylalkyd resins, urea resins, aminoalkyd resins, melamine resins and phenolic resins. These resins mentioned as above when used in amounts of less than 20.0% or more 50.0% will fail to form a satisfactory resinous film on an aluminum surface.

The aluminum surface in the above second mentioned process is advantageously anodized for 5 – 30 minutes with DC 40–60 volts and a current density of 0.01 – 1 A/dm$^2$ at a bath temperature of 50° – 90° C. More advantageously, the surface can be anodized initially with a relatively low voltage i.e. DC 10–20 volts for 5 – 15 minutes, thereby forming thereon an oxide film and then with a relatively high voltage i.e. DC 30–60 volts for 1 – 15 minutes thereby electrically depositing thereon a resinous film.

The following examples are provided to further illustrate the process of the invention, but these are not to be regarded as limiting.

EXAMPLE I

An aluminum workpiece was subjected to the pretreatment in which it was degreased and cleaned by dipping for 30 seconds in 8% NaOH solution maintained at 80° C, washed with water, neutralized by dipping for 15 seconds in a 15% $HNO_3$ solution at room temperature, and washed again with water. The pretreated substrate was subjected to anodization using an electrolyte containing 3 weight percent of ETHODUOMEEN (trade name for ethylene oxide adduct of fatty acid diamine) operated with DC 55 volts source and a current density of 1 A/dm² at a bath temperature of about 30° C. The substrate was thus anodized for 15 minutes, whereupon there was obtained a transparent oxide film deposited on the aluminum workpiece.

EXAMPLE II

An aluminum-bearing substrate was pretreated in the manner described in EXAMPLE I. The pretreated substrate was subjected to anodization using an electrolyte containing 10 weight percent of ethylene diamine operated with DC 30 volts and a current dinsity of 0.5 A/dm² at a bath temperature of about 18° C. The substrate was thus anodized for 30 minutes, whereupon a transparent oxide film was produced on the aluminum workpiece.

EXAMPLES III – V

Aluminum workpieces were subjected to the pretreatment in which they were degreased and cleaned by dipping for 30 seconds in 8% NaOH solution maintained at 80° C, washed with water, neutralized by dipping for 20 seconds in a 15% $HNO_3$ solution at room temperature, and washed again with water.

The thus pretreated substrates were subjected to anodization using electrolytes containing 1.0, 3.0 and 5.0 weight percent respectively of N-methyl-ethanol amine operated with DC 50 – 100 volts and a current density of 0.15–0.55 A/dm² at a bath temperature of about 11° C. The substrate was thus anodized for 15 minutes whereupon a transparent oxide film was produced on each aluminum substrate.

COMPARATIVE EXAMPLE

An aluminum substrate was pretreated in the manner described in EXAMPLE I. The pretreated substrate was subjected to anodization using a 15% $H_2SO_4$ electrolyte operated with DC 15 volts and a current density of 1 A/dm² at a bath temperature of about 20° C. The substrate was thus anodized for 15 minutes, then washed and dried thereby providing a comparative test piece. This test piece together with the aluminum piece obtained according to EXAMPLE I and EXAMPLE II were immersed for 1 minute in an immersion bath containing the coating compositions shown in Table 1. They were taken out of the bath, disposed to set over a period of 10 minutes and thereafter were heated in an electrical furnace at a temperature of 180° for 20 minutes, until they were dried and hardened. The finished aluminum pieces were subjected to an adhesion test, with the results shown in Table 1. It will be seen that aluminum pieces obtained in the inventive examples were superior to one in a comparative example in respect of adhesion.

Table I

| Coating compositions (parts by weight) | | | | | | | | Adhesion (kg/cm²) | | |
|---|---|---|---|---|---|---|---|---|---|---|
| Coat No. | Resin (solid 100%) | Butanol | Isopropanol | Ethylene glycol mono-buthyl ether | Water | Anionic surfactant | Organic amine | Comparative example | Example I | Example II |
| 1 | Water-soluble acrylic resin | — | 22 | 90 | 30 | 0.5 | 7.5 | 24.0 | 26.2 | 27.0 |
| 2 | Water-soluble alkyd resin | 12 | 20 | 80 | 30 | 0.5 | 7.5 | 17.0 | 18.5 | 19.2 |
| 3 | Water-soluble acrylalkyd resin | 12 | 20 | 80 | 30 | 0.5 | 7.5 | 17.5 | 20.2 | 21.5 |

EXAMPLE VI

An aluminum substrate was pretreated in the manner described in EXAMPLE I. The pretreated substrate was subjected to anodization using an electrolyte of the composition shown in Table II operated with DC 60 or less volts and a current density of 1 A/dm² at a bath temperature of 90° C. The substrate was thus anodized for 20 minutes, and then pulled out, drained for 8 minutes, allowed to set for 7 minutes and thereafter heated at 180° C for 30 minutes to harden the coating, whereupon there was produced a continuous, uniform, firmly adhered film on the aluminum workpiece.

Table II

| Electrolyte Composition (weight percent) | |
|---|---|
| Titanium oxide | 37.2 |
| Acrylic resion | 16.2 |
| Melamine resion | 4.0 |
| ETHODUOMEEN | 5.0 |
| Glycol | 11.0 |
| Ethylalcohol | 17.0 |
| Water | 5.0 |
| Surfactant | 4.6 |

EXAMPLE VII

An aluminum substrate was pretreated in the manner described in EXAMPLE I. The pretreated substrate was subjected to anodization using an electrolyte of the composition shown in Table III operated with DC 40 volts and a current density of 0.5 A/dm² at a bath temperature of 80° C. The substrate was then anodized for 15 minutes, and then pulled out, drained for 8 minutes, allowed to set for 7 minutes and thereafter heated at 180° C for 30 minutes to harden the coating, whereupon there was produced a continuous, uniform, firmly adhered film on the aluminum workpiece.

Table III

| Electrolyte Composition (weight percent) | |
|---|---|
| Titanium oxide | 37.0 |
| Acrylic resion | 15.0 |
| Melamine resin | 4.0 |
| Ethylene diamine | 10.0 |
| Glycol | 9.0 |
| Ethylalcohol | 16.0 |
| Water | 5.0 |
| Surfactant | 4.0 |

EXAMPLE VIII

An aluminum substrate was pretreated in the manner described in EXAMPLES III–V. The pretreated substrate was subjected to anodization using an electrolyte of the composition shown in Table IV operated with DC 10–20 volts and a current density of 0.02–0.08 A/dm$^2$ at a bath temperature of 40° ± 2° C. The substrate was thus anodized for 10 minutes and thereafter further anodized with DC 30 volts for 1 minute, and then pulled out, drained for 8 minutes, allowed to set for 7 minutes and then heated at 180° C for 30 minutes to harden the coating, whereupon there was produced a continuous, uniform, firmly adhered film on the aluminum workpiece.

Table IV

| Electrolyte composition (weight percent) | |
|---|---|
| Acrylic resion | 27.4 |
| Melamine resion | 4.0 |
| N-methyl ethanol amine | 1.0 |
| Glycol | 11.0 |
| Ethylalcohol | 17.0 |
| Water | 35.0 |
| Surfactant | 4.6 |

What is claimed is:

1. A process for coating an aluminum or aluminum alloy surface which comprises: degreasing, cleaning and water-rinsing the surface; etching the water-rinsed surface with an alkaline solution; neutralizing and water-washing the etched surface; and treating the surface as the anode for 5 – 30 minutes with DC 40 – 60 volts and a current density of 0.01 – 1 A/dm$^2$ at a bath temperature of 50° – 90° C. in an aqueous electrolyte containing 1.0 – 15.0 weight per cent of at least one compound soluble under the experimental conditions in the aqueous solution selected from the group consisting of aliphatic primary amines and aliphatic secondary amines and 20.0 – 50.0 weight per cent of at least one water-soluble thermosetting resin to form a resin coating, allowing the thus treated and coated surface to set; and drying and hardening the same at a temperature of 150° – 200° C. over a period of 15 – 30 minutes.

2. The process as claimed in claim 1 wherein said anodizing is effected initially with a relatively low voltage and subsequently with a relatively high voltage.

3. The process according to claim 1 wherein said thermosetting resin is an acrylic resin, an acrylalkyd resin, a urea resin, an aminoalkyd resin, a melamine resin or a phenolic resin.

4. The process according to claim 1, wherein the amine is the adduct of ethylene oxide and a fatty acid diamine, ethylenediamine, N-methyl - ethanolamine or dimethylamine.

5. The process according to claim 1 wherein a surfactant is added to said electrolyte.

6. The process according to claim 1, wherein titanium oxide is added to said electrolyte.

7. An aluminum workpiece treated by the process of claim 1.

* * * * *